US009127395B2

(12) United States Patent
Kim et al.

(10) Patent No.: US 9,127,395 B2
(45) Date of Patent: Sep. 8, 2015

(54) WASHING MACHINE

(75) Inventors: Bo Yeon Kim, Changwon-si (KR); Hyung Gyu Lim, Changwon-si (KR); In Ho Cho, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 12/292,560

(22) Filed: Nov. 20, 2008

(65) Prior Publication Data

US 2009/0145176 A1 Jun. 11, 2009

(30) Foreign Application Priority Data

Nov. 21, 2007 (KR) ..... 10-2007-0118963
Nov. 21, 2007 (KR) ..... 10-2007-0118964
Nov. 21, 2007 (KR) ..... 10-2007-0118965
Apr. 30, 2008 (KR) ..... 10-2008-0040589

(51) Int. Cl.

| | |
|---|---|
| ***D06F 29/00*** | (2006.01) |
| ***D06F 29/02*** | (2006.01) |
| ***D06F 31/00*** | (2006.01) |
| ***D06F 39/08*** | (2006.01) |
| ***D06F 39/12*** | (2006.01) |

(52) U.S. Cl.

CPC ..... *D06F 39/125* (2013.01); *D06F 29/00* (2013.01); *D06F 29/02* (2013.01); *D06F 31/00* (2013.01); *D06F 39/081* (2013.01); *D06F 39/12* (2013.01); *Y10T 29/53* (2015.01)

(58) Field of Classification Search

CPC ..... D06F 29/00; D06F 29/02; D06F 31/00; D06F 39/081; D06F 39/12; D06F 39/125

USPC ..... 68/3 R, 19.1, 20, 27

See application file for complete search history.

(56) References Cited

U.S. PATENT DOCUMENTS

| | | | | | |
|---|---|---|---|---|---|
| 169,760 | A | | 11/1875 | Baker | |
| 2,048,608 | A | | 7/1936 | Holland | |
| 2,165,487 | A | * | 7/1939 | Johnson | 68/18 C |
| 2,372,769 | A | | 4/1945 | De Remer | |
| 2,411,383 | A | * | 11/1946 | Miller | 248/620 |
| 2,566,488 | A | * | 9/1951 | Gould | 68/20 |
| 2,570,529 | A | | 10/1951 | Dolan | |
| 2,579,310 | A | * | 12/1951 | Dunham | 68/25 |
| 2,655,804 | A | | 10/1953 | Clark | |

(Continued)

FOREIGN PATENT DOCUMENTS

| | | | |
|---|---|---|---|
| AR | 197471 | A1 | 4/1974 |
| AR | 198520 | A1 | 6/1974 |

(Continued)

OTHER PUBLICATIONS

European Patent Office 0 747 523 Dec. 1996.*

(Continued)

*Primary Examiner* — Michael Barr
*Assistant Examiner* — Levon J Shahinian
(74) *Attorney, Agent, or Firm* — Dentons US LLP

(57) ABSTRACT

A washing machine is disclosed. A washing machine includes a tub holding wash water, a drum rotatable within the tub to hold laundry, a first cabinet defining a first space to wash laundry together with the tub and the drum, a second cabinet defining a second space for an additional function, the second cabinet formed as one body with the first cabinet, and a single partition provided between the first and second cabinets to partition off the second space from the first space.

16 Claims, 16 Drawing Sheets

(56) References Cited

U.S. PATENT DOCUMENTS

| | | | | | |
|---|---|---|---|---|---|
| 2,750,779 | A | | 6/1956 | Whyte | |
| 2,816,429 | A | * | 12/1957 | Kurlancheek | 68/19.2 |
| 2,866,273 | A | * | 12/1958 | Geldhof | 34/75 |
| 2,881,609 | A | * | 4/1959 | Brucken | 68/19.2 |
| 3,044,667 | A | | 7/1962 | Lucas | |
| 3,402,477 | A | * | 9/1968 | Hubbard | 34/543 |
| 3,421,801 | A | * | 1/1969 | Carpenter et al. | 312/111 |
| 3,539,011 | A | * | 11/1970 | Hopkins | 210/146 |
| 3,555,701 | A | * | 1/1971 | Hubbard | 34/602 |
| 4,109,397 | A | | 8/1978 | Daily | |
| 4,413,867 | A | * | 11/1983 | Mosebrook et al. | 312/111 |
| 5,078,282 | A | * | 1/1992 | Stanfield | 211/74 |
| 5,080,204 | A | * | 1/1992 | Bauer et al. | 188/129 |
| 5,365,959 | A | | 11/1994 | Favaro | |
| 5,382,087 | A | | 1/1995 | Pouch | |
| 5,470,142 | A | | 11/1995 | Sargeant et al. | |
| 5,653,416 | A | | 8/1997 | Frank | |
| 6,036,150 | A | | 3/2000 | Lehrman | |
| 6,427,966 | B1 | | 8/2002 | Blumenschein | |
| 6,618,887 | B2 | | 9/2003 | Kim et al. | |
| 6,671,978 | B1 | * | 1/2004 | McGowan et al. | 34/596 |
| 6,874,248 | B2 | * | 4/2005 | Hong et al. | 34/239 |
| 6,978,556 | B1 | * | 12/2005 | Cornelious | 34/596 |
| 7,117,612 | B2 | * | 10/2006 | Slutsky et al. | 34/321 |
| 7,513,132 | B2 | | 4/2009 | Wright et al. | |
| 7,628,043 | B2 | * | 12/2009 | Sunshine et al. | 68/38 |
| 2002/0042957 | A1 | | 4/2002 | Kim et al. | |
| 2002/0056293 | A1 | | 5/2002 | Kim | |
| 2004/0134092 | A1 | * | 7/2004 | Hong et al. | 34/595 |
| 2004/0226320 | A1 | | 11/2004 | Bongini | |
| 2004/0244436 | A1 | | 12/2004 | Park et al. | |
| 2005/0103063 | A1 | | 5/2005 | Namkung et al. | |
| 2005/0155393 | A1 | | 7/2005 | Wright et al. | |
| 2005/0172678 | A1 | | 8/2005 | Kim et al. | |
| 2005/0178165 | A1 | | 8/2005 | Carey et al. | |
| 2005/0275325 | A1 | | 12/2005 | Yang | |
| 2006/0081014 | A1 | * | 4/2006 | Choi et al. | 68/3 R |
| 2006/0130535 | A1 | * | 6/2006 | Sunshine et al. | 68/3 R |
| 2006/0156765 | A1 | | 7/2006 | Sunshine et al. | |
| 2007/0119072 | A1 | | 5/2007 | Kim | |
| 2007/0151120 | A1 | | 7/2007 | Tomasi et al. | |
| 2007/0151300 | A1 | | 7/2007 | Sunshine | |
| 2007/0234678 | A1 | * | 10/2007 | Massengill | 52/677 |
| 2007/0249212 | A1 | | 10/2007 | Buecker et al. | |
| 2008/0011342 | A1 | | 1/2008 | Ryu et al. | |

FOREIGN PATENT DOCUMENTS

| | | | | |
|---|---|---|---|---|
| AR | 056529 | A1 | | 10/2007 |
| CN | 1349012 | A | | 5/2002 |
| CN | 1542208 | | | 11/2004 |
| CN | 1715518 | | | 1/2006 |
| CN | 1880554 | A | | 12/2006 |
| DE | 94 19 048 | | | 3/1995 |
| DE | 203 02 572 | | | 4/2003 |
| DE | 20 2004 010 585 | U1 | | 9/2004 |
| DE | 10 2005 036 062 | | * | 2/2007 |
| DE | 10 2006 055 379 | | | 6/2007 |
| DE | 10 2008 027 977 | | | 1/2009 |
| EP | 0 238 115 | | | 9/1987 |
| EP | 0 882 768 | A2 | | 12/1998 |
| EP | 0 950 749 | | | 10/1999 |
| EP | 1233100 | A1 | | 8/2002 |
| EP | 1 369 523 | | | 12/2003 |
| EP | 1 550 756 | A1 | | 7/2005 |
| EP | 1 621 660 | A2 | | 2/2006 |
| EP | 1 726 703 | | | 11/2006 |
| FR | 1 182 103 | | | 6/1959 |
| GB | 566372 | | | 12/1944 |
| GB | 817788 | | | 8/1959 |
| GB | 846 251 | | | 8/1960 |
| GB | 1 510 528 | | | 5/1978 |
| JP | 53-0047164 | | * | 4/1978 |
| JP | 54-108060 | | | 8/1979 |
| JP | 02-261499 | | * | 10/1990 |
| JP | 9-215888 | | | 8/1997 |
| JP | 10015276 | | | 1/1998 |
| JP | 11-309292 | A | | 11/1999 |
| JP | 2005-270593 | | * | 10/2005 |
| KR | 2000-0010250 | U | | 6/2000 |
| KR | 10-0335086 | A | | 7/2001 |
| KR | 10-2004-0009400 | A | | 1/2004 |
| KR | 20-0358180 | Y1 | | 7/2004 |
| KR | 1020050086205 | A | | 8/2005 |
| KR | 1020060081939 | A | | 7/2006 |
| KR | 701329 | | * | 3/2007 |
| KR | 100774208 | B1 | | 11/2007 |
| KR | 10-0822153 | B1 | | 4/2008 |
| RU | 2 291 922 | | | 1/2007 |
| RU | 2317357 | | | 2/2008 |
| WO | WO 02/12609 | A1 | | 2/2002 |
| WO | WO 2004/069019 | A2 | | 8/2004 |
| WO | WO 2008/069607 | A2 | | 6/2008 |
| WO | WO 2008/084932 | A2 | | 7/2008 |

OTHER PUBLICATIONS

European Office Office 0 943 721 Sep. 1999.*

* cited by examiner

WASHING MACHINE

CROSS REFERENCE TO RELATED APPLICATION

This application claims the benefit of the Korean Patent Application Nos. 10-2007-0118963 filed on Nov. 21, 2007, 10-2007-0118964 filed on Nov. 21, 2007, 10-2007-0118965 filed on Nov. 21, 2007, and 10-2008-0040589 filed on Apr. 30, 2008 which are hereby incorporated by reference as if fully set forth herein.

BACKGROUND OF THE DISCLOSURE

1. Field of the Disclosure

The present invention relates to a washing machine. More particularly, the present invention relates to a cabinet of a washing machine.

2. Discussion of the Related Art

Typically, washing machines are electric appliances which wash washing objects such as clothes, cloth items and beddings (hereinafter, laundry) by using mechanical friction between laundry and detergent. Such the washing machine may be useable combinedly together with auxiliary devices having a predetermined size.

The auxiliary device may be provided under or on the washing machine and it can provide a user with various kinds of additional functions. However, these auxiliary devices are designed and produced as independent devices from the washing machine. As a result, if these independent auxiliary devices are installed at the washing machine, lots of works may be required. In addition, it is common that an exterior appearance of the washing machine having auxiliary device installed together may not be satisfactory.

SUMMARY OF THE DISCLOSURE

Accordingly, the present invention is directed to a device for treating laundry which is capable of securing a water drain height, with improved inner space utilization.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

The present invention is invented to provide a washing machine having a high productivity and enhanced exterior appearance.

To achieve these objects and other advantages and in accordance with the purpose of the invention, as embodied and broadly described herein, a washing machine includes a tub holding wash water; a drum rotatable within the tub to hold laundry; a first cabinet defining a first space to wash laundry together with the tub and the drum; a second cabinet defining a second space for an additional function, the second cabinet formed as one body with the first cabinet; and a single partition provided between the first and second cabinets to partition off the second space from the first space.

In another aspect, a method of assembling a washing machine includes assembling a first cabinet having an open top panel; assembling a second cabinet having an open bottom; coupling a single partition to the top panel of the second cabinet; and coupling the second cabinet with the first cabinet.

The coupling of the second cabinet with the first cabinet may include turning the first cabinet upside down; and coupling the coupled second cabinet and single partition with a bottom of the reversed first cabinet.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts.

Figure 1:
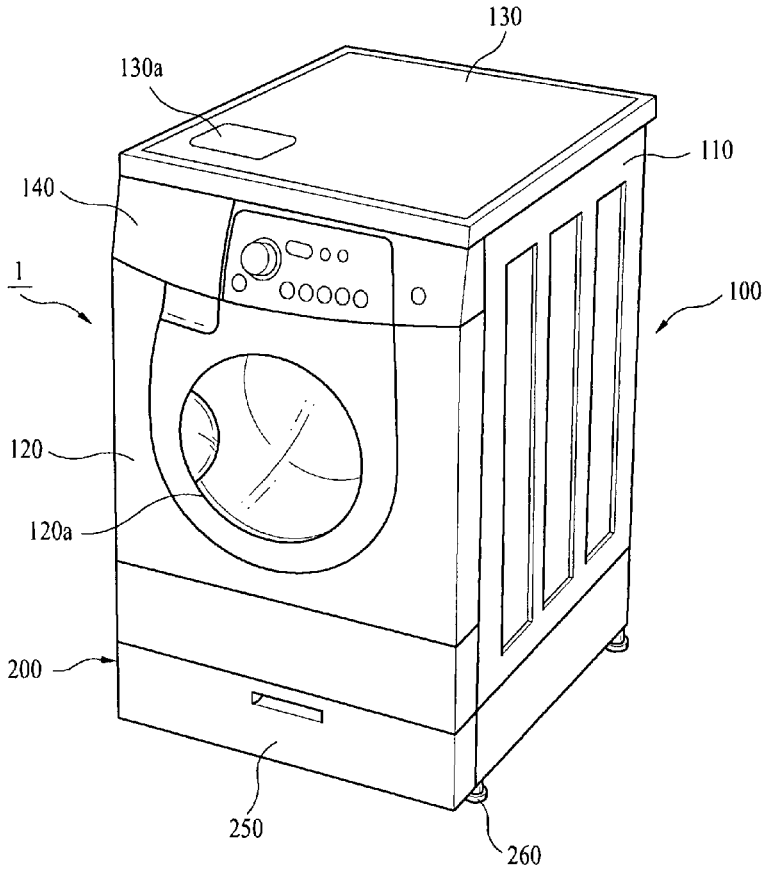
FIG. 1 is a perspective view illustrating a washing machine according to an exemplary embodiment.
Figure 2A:
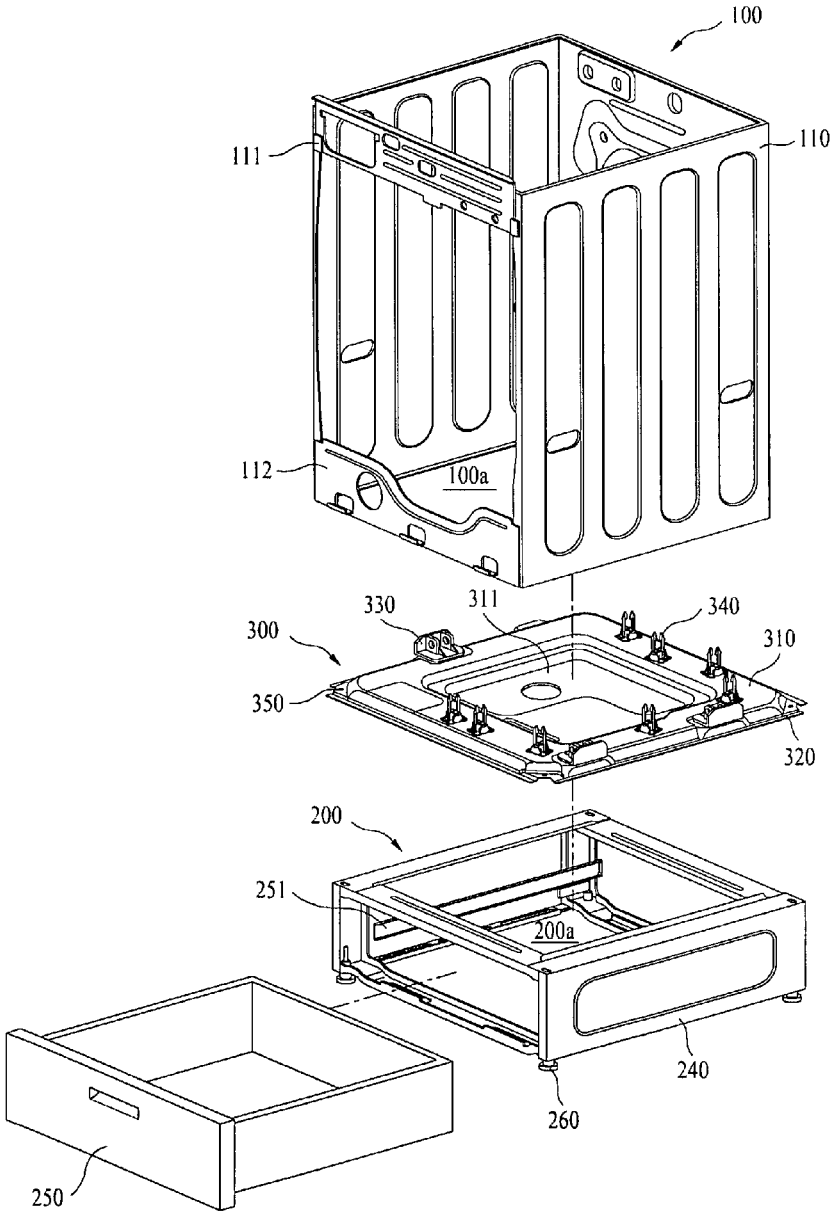
FIG. 2*a* is an exploded perspective view illustrating a cabinet provided in the washing machine of FIG. 1.
Figure 2B:
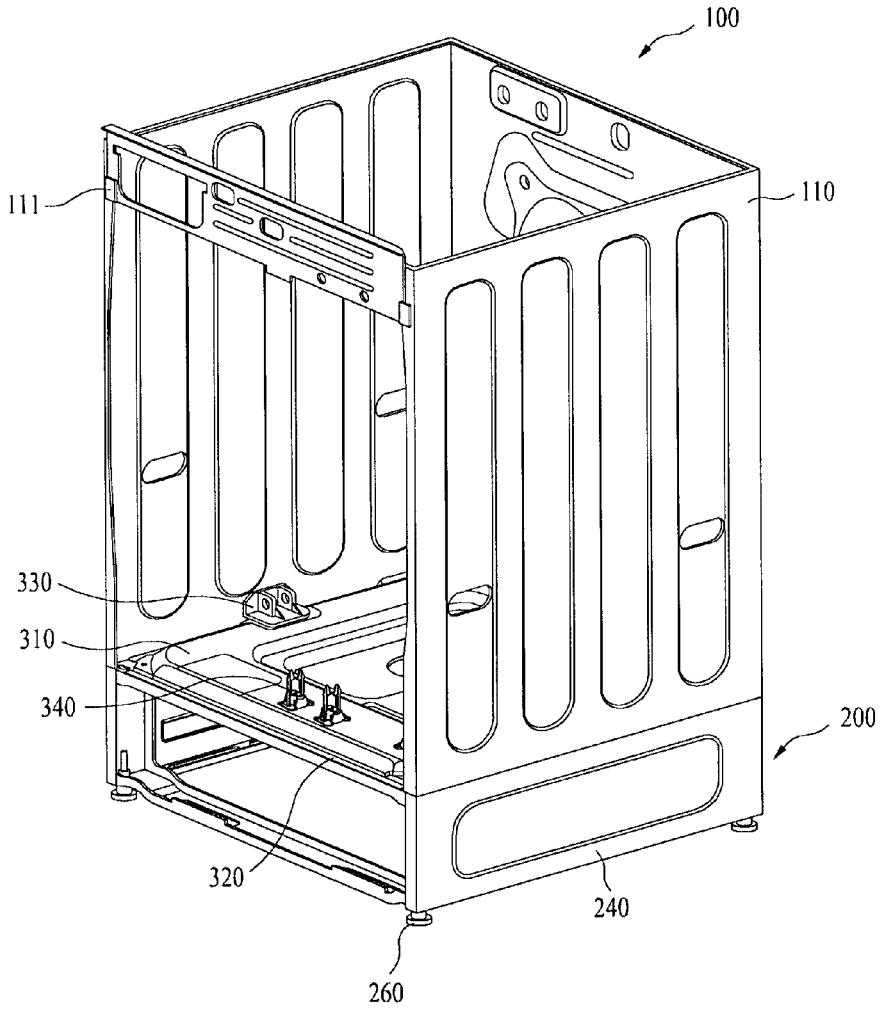
FIG. 2*b* is a perspective view illustrating the cabinet.

FIG. 1 is a perspective view illustrating a washing machine according to an exemplary embodiment. FIG. 2*a* is an exploded perspective view illustrating a cabinet of the washing machine. FIG. 2*b* is a perspective view illustrating a state that components of the cabinet shown in FIG. 2*a* are coupled to each other.

In reference to FIGS. 1 to 2*b*, a washing machine 1 according to an exemplary embodiment includes a first cabinet 100 defining a main body.

The first cabinet 100 is configured of a body 110 including side panels and a rear panel. The body 110 forms a first space 100*a* and mechanical devices for washing laundry are accommodated in the first space 100*a*. For example, a tub is installed in the first space 100*a* to hold wash water and a drum is rotatably installed in the tub to hold the laundry and to perform washing. In addition, power devices are installed at a rear portion or a lower portion of the tub to rotate the drum.

As shown in FIG. 1, a front panel 120 is coupled to a front of the body 110 and a door 120*a* is coupled to the front panel 120. As shown in FIG. 2, a panel frame 111 is installed at an upper front portion of the body 110 and a control panel 140 shown in FIG. 1 is mounted on the panel frame 111. As shown in 2*a*, a lower frame 112 is provided under a lower front portion of the body 110 and peripheral devices including a pump are installed at the lower frame 112. As shown in FIG. 1, a top panel 130 is installed at an upper portion of the body 110 and a cover 130*a* of a detergent box 130*a* is installed at the top panel 130.

The washing machine 1 according to the exemplary embodiment includes a second cabinet 200 provided adjacent to the first cabinet 100. A second space 200*a* is formed in the second cabinet 200 and devices for additional functions may be accommodated in the second space 200*a*. As shown in FIG. 2*a*, the second cabinet 200 may accommodate a drawer 250 forming a predetermined storage space for the additional functions. To retract the drawer 250 smoothly, as shown in FIG. 2*a*, guide rails 251 may be installed at both opposite side panels of the second cabinet 200, respectively.

For example, the second space 200*a* may accommodate accessories, that is, tools for repairing the washing machine, for example, a manual, detergent and bleach. Whenever necessary, the user can take out the accessories from the second space 200*a*. If the drawer 250 is installed in the second space 200*a*, the accessories are accommodated in the drawer 250 and then the user can store the accessories conveniently.

On the other hand, the second space 200*a* may be configured to accommodate auxiliary washing machines. Such the auxiliary washing machines may wash relatively small sized laundry, for example, handkerchiefs, socks and infants' or children's clothes.

Specifically, the auxiliary washing machine may include an auxiliary tub for holding wash water and an auxiliary drum for holding laundry. Here, the auxiliary washing machine may further include other elements which enable small sized laundry to be washed. Such the auxiliary washing machine may perform all of the processes required to wash and dry the small sized laundry, specifically, a washing, rinsing, spinning and drying cycle.

If the auxiliary tub and drum lay down sideways and their introduction openings are toward the front of the washing machine, a door may be installed at the front of the second cabinet 200 to introduce the laundry to the auxiliary drum inside. If the auxiliary tub and drum stands vertically, such the auxiliary tub and drum may be accommodated in the drawer 250. If the user pulls the drawer 250 forward, an opening of the auxiliary drum standing vertically is exposed and the laundry may be loaded in the auxiliary drum via the exposed opening. Hence, the user pushes the drawer 250 backward into the second cabinet 200 and selected cycles for the small sized laundry may be performed.

The above auxiliary washing machine may perform washing for the relatively small sized laundry simultaneously while the main washing machine within the first cabinet 100 is performing washing for the relatively large laundry. As a result, because of the auxiliary washing machine, the washing capacity of the washing machine is substantially increased and also washing efficiency is improved.

On the other hand, the second space 200*a* may accommodate washed shoes and clothes. Hot air may be supplied to the second space 200*a* by an auxiliary mounted device. As mentioned above, the shoes and the washed clothes may be accommodated in the drawer 250 conveniently. Accordingly, the shoes and clothes are dried and refreshed by the supplied hot air.

The second cabinet 200 may be provided in any portions of the first cabinet 100 including a top or a bottom panel of the first cabinet 100. However, if the second cabinet 200 is provided under the bottom panel of the first cabinet 100 as mentioned above, the second cabinet 200 may be employed as a supporter of the first cabinet 100 to lift the first cabinet 100 to a predetermined height. If then, a leg 260 may be installed at the bottom panel of the second cabinet to support the washing machine.

The second cabinet 200 accommodates the additional device to substantially supply the user the additional functions as mentioned above. If the second cabinet 200 is designed as an independent device, the independent second cabinet 200 is fabricated and after that the first cabinet 100 should be installed again, which requires more works.

As a result, the second cabinet 200 may be formed as one body with the first cabinet 100. The united first and second cabinets 100 and 200 make it possible for the washing machine to save the material and works required by this washing machine as well as to supply the user the additional functions.

If the first and second cabinets 100 and 200 are fabricated as some parts of independent devices, the first and second cabinets 100 and 200 have legs installed at the lower surface of the first and second cabinets 100 and 200. For example, if the first cabinet 100 is put on the second cabinet, the legs of the first cabinet 100 do not have to be provided. This is because the legs of the first cabinet 100 can be a reason of increasing the overall height of the first and second cabinets 100 and 200. As mentioned above, if the first and second cabinets 100 and 200 are formed as one body, the structure of the first and second cabinets 100 and 200 can be compact because the unnecessary legs may not increase the overall height of the first and second cabinets 100 and 200.

By the way, the first and second spaces 100*a* and 200*a* may accommodate devices having separate functions, respectively. Thus, the above spaces may be separate from each other to avoid the interference among the devices.

Because of the united body of the first and second cabinets 100 and 200, the bottom panel of the first cabinet 100 is in close contact with the top panel of the second cabinet 200. If two separate members are provided at the top panel of the second cabinet and the bottom panel of the first cabinet 100, respectively, the first space 100*a* is separated from the second space 200*a* more definitely and the structural rigid and strength of the washing machine may be achieved. However, this structure may cause a disadvantage of increased weight and works of the washing machine, which is bigger than the expected advantage, and thus it is not preferable. Because of that, a single partition 300 may be provided between the first and second cabinets 100 and 200.

The single partition 300 partitions off the second space 200*a* from the first space 100*a* such that the first and second spaces 100*a* and 200*a* may perform their functions without interference.

In addition, there is no additional partition between the first and second cabinets 100 and 200 and thus the partition 300 covers the bottom of the first cabinet 100, simultaneously covering the top panel of the second cabinet 200. As a result, the partition 300 directly faces the first and second spaces 100*a* and 200*a*.

That is, the partition 300 forms both a predetermined portion of the first cabinet 100 and a predetermined portion of the second cabinet 200 simultaneously. Such the partition 300 can give the washing machine a preferable structural rigid and strength and it prevents the increase of the unnecessary material and works which might happen during the separation of the spaces 100*a* and 200*a*. Moreover, the common element of the partition 300 in both of the first and second cabinets 100 and 200 makes accomplished the substantial united structure between the first and second cabinets 100 and 200.

In addition, the partition 300 may be employed as an element for the accessories required in the washing machines to be mounted, rather than the separation of the first and second spaces 100*a* and 200*a* and the security of the structural strength. Specifically, the partition 300 includes a platform 310 projected to a predetermined height as shown in FIG. 2*a* and an edge portion 320 of a flange type. Because of the platform 310, the partition 300 may have plural bent portions for increasing its section modulus, which results in improved structural strength.

In reference to FIG. 2*a*, on the platform 310 may be installed a plurality of brackets 330, holders 340 and other members additionally.

First, the brackets 330 enable the tub to be mounted on the partition 300, specifically, the brackets 330 are coupled to a damper dampening vibration of the tub.

The holders 340 fix various accessories, for example, wires and terminals of the washing machine may be fixed to the holders 330.

Figure 3:
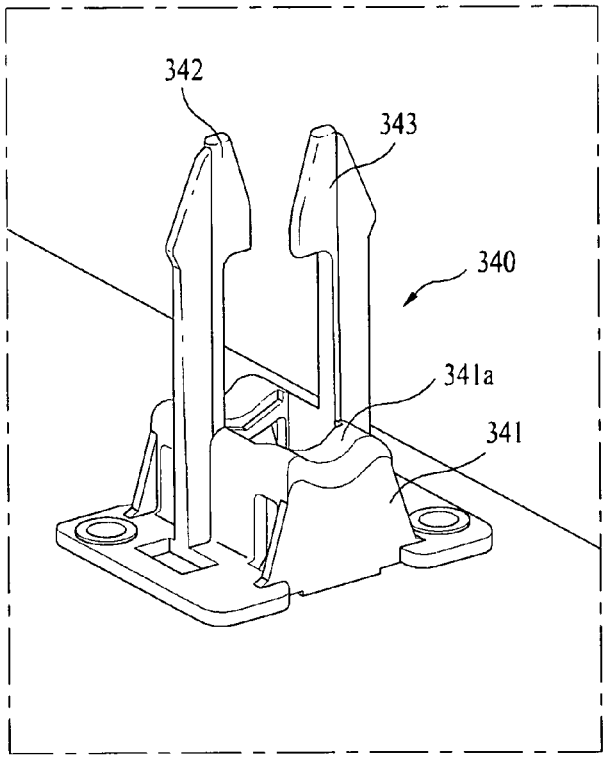
FIG. 3 is a perspective view illustrating a holder coupled to a partition of the cabinet.

As shown in FIG. 3, the holder 340 includes a base 341 secured to the partition 300 and a pair of arms extended upward from the base 341. The pair of the arms may include a first arm 342 and a second arm 343.

The accessories such as the wires may be arranged between the first and second arms 342 and 343 to be seated on a seating portion 341*a* formed on the base 341. The first and second arms 342 and 343 have hooks formed at upper ends of the arms 342 and 343, respectively, and these hooks prevent the separation of the accessories seated between the first and second arms 342 and 343.

The wires may be wound around the first and second arms 342 and 343 and the accessory having a predetermined volume such as a terminal may be hooked at the first and second arms 342 and 343, specifically, the hooks of the first and second arms.

As shown in FIG. 2*a*, the partition 300 may further include a recess 311 formed at a center of the platform 310. Water leaked from the tub or the drum may be primarily stored in the recess 311 not to flow outside the washing machine. In addition, a device capable of sensing the leaked water may be installed in the recess 311.

The partition 300 may have a structure where the leg supporting the first cabinet can be coupled. Specifically, as shown in FIG. 2*a*, a coupling hole 350 may be formed at each corner of the partition 300 and the legs are coupled to the coupling holes 350. Because of this leg coupling structure, the partition 300 may be applicable to the conventional washing machine having only the first cabinet 100 without the second cabinet 200, which can bring common usage of parts capable of improving productivity.

While the above embodiments present the first and second cabinets 100 and 200 having separate side and/or rear panels, the first and second cabinets 100 and 200 may have side and/or rear panels which are unitedly formed as one body. That is, the cabinets 100 and 200 may have only a single side and/or rear panel. As result, similar to the single partition 300, the single side and/or rear panel is shared by the first and second cabinets 100 and 200 such that the first and second cabinets may be substantially united as one body and that the assembly line and material/parts may be reduced.

Figure 4A:
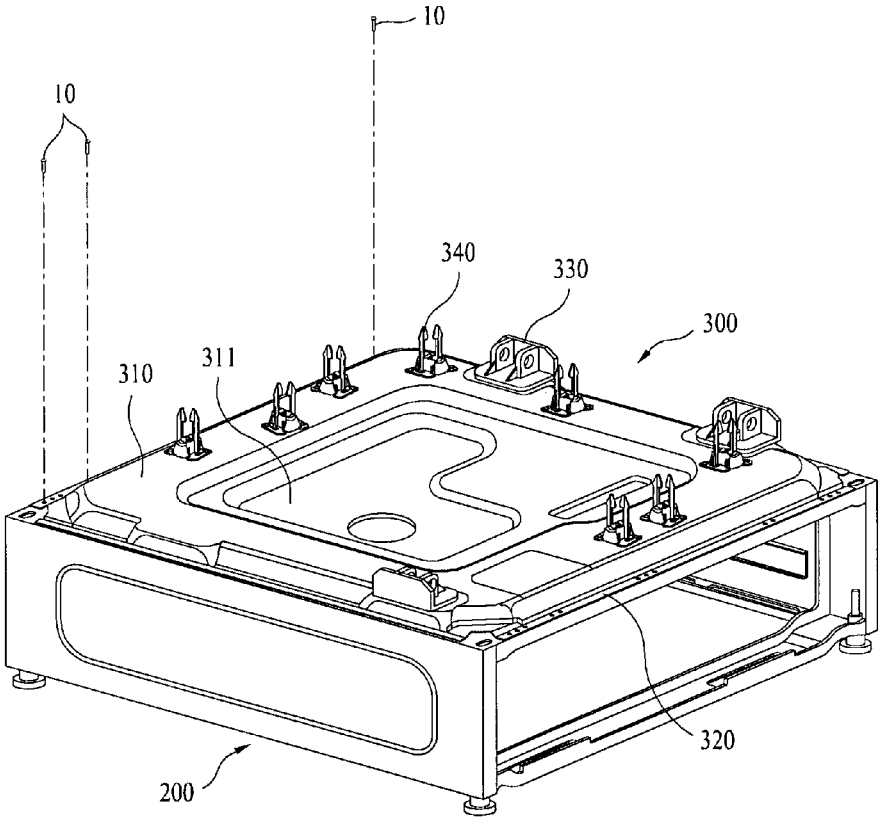
FIGS. 4*a* to 4*c* are perspective views illustrating an assembly process of the cabinet, respectively.
Figure 4B:
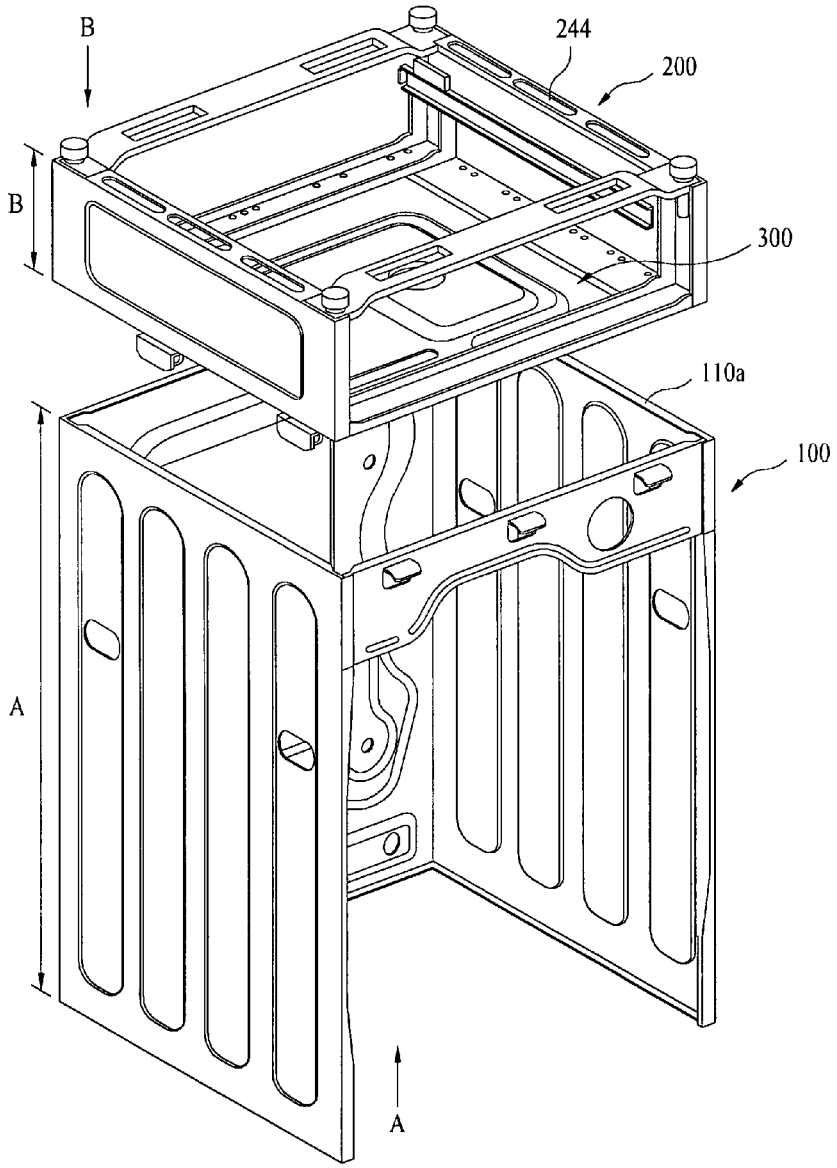

FIGS. 4*a* and 4*b* are perspective views illustrating each assembly process of the first and second cabinets, respectively, showing assemblies seen from different angles for each assembly process. In reference to FIGS. 4*a* and 4*b*, the assembly process of the cabinets provided in the washing machine according to the present invention will be described.

As shown in FIG. 4*a*, the partition 300 is coupled to the top panel of the second cabinet 200. Specifically, the partition 300 is put on the top panel of the second cabinet 200 and the edge portions 320 of the partition 300 are secured to edges of the top panel of the second cabinet 200 by securing members.

At a structural point of view, the partition 300 may be coupled to the bottom of the first cabinet 100 before coupled to the top panel of the second cabinet 200. However, the first cabinet 100 has a substantially much bigger volume than the second cabinet 200. If the partition 300 forms a primary assembly together with the first cabinet 100, it is inconvenient for a worker to work the primary assembly because of the increased weight and volume. Accordingly, as mentioned above, it is advantageous for worker convenience sake to form a primary assembly of the partition 300 and the second cabinet 200.

Next, as shown in FIG. 4*b*, the first cabinet 100 and the primary assembly 200 and 300 are turned upside down.

Specifically, after the first cabinet 100 is turned upside down first, the reversed primary assembly 200 and 300 may be put on the bottom of the first cabinet 100.

According to the conventional assembly, the first cabinet 100 and the primary assembly 200 and 300 are not turned upside down and the first cabinet 100 is put on the top panel of the primary assembly 200 and 300. If then, the securing member secures the first cabinet 100 to the primary assemblies 200 and 300 along a direction of (A) as shown in an arrow.

However, it is inconvenient for the worker to fasten the securing member by using tools because the first cabinet 100 has a side panel with a predetermined height (A). While, the primary assembly 200 and 300 has a substantially less height (B) than the height (A). As a result, it is easy for the worker to use the tools. Reversing both of the first cabinet 100 and primary assembly 200 and 300 may make it convenient for the worker to fasten the first cabinet 100 to the primary assemblies 200 and 300.

Figure 4C:
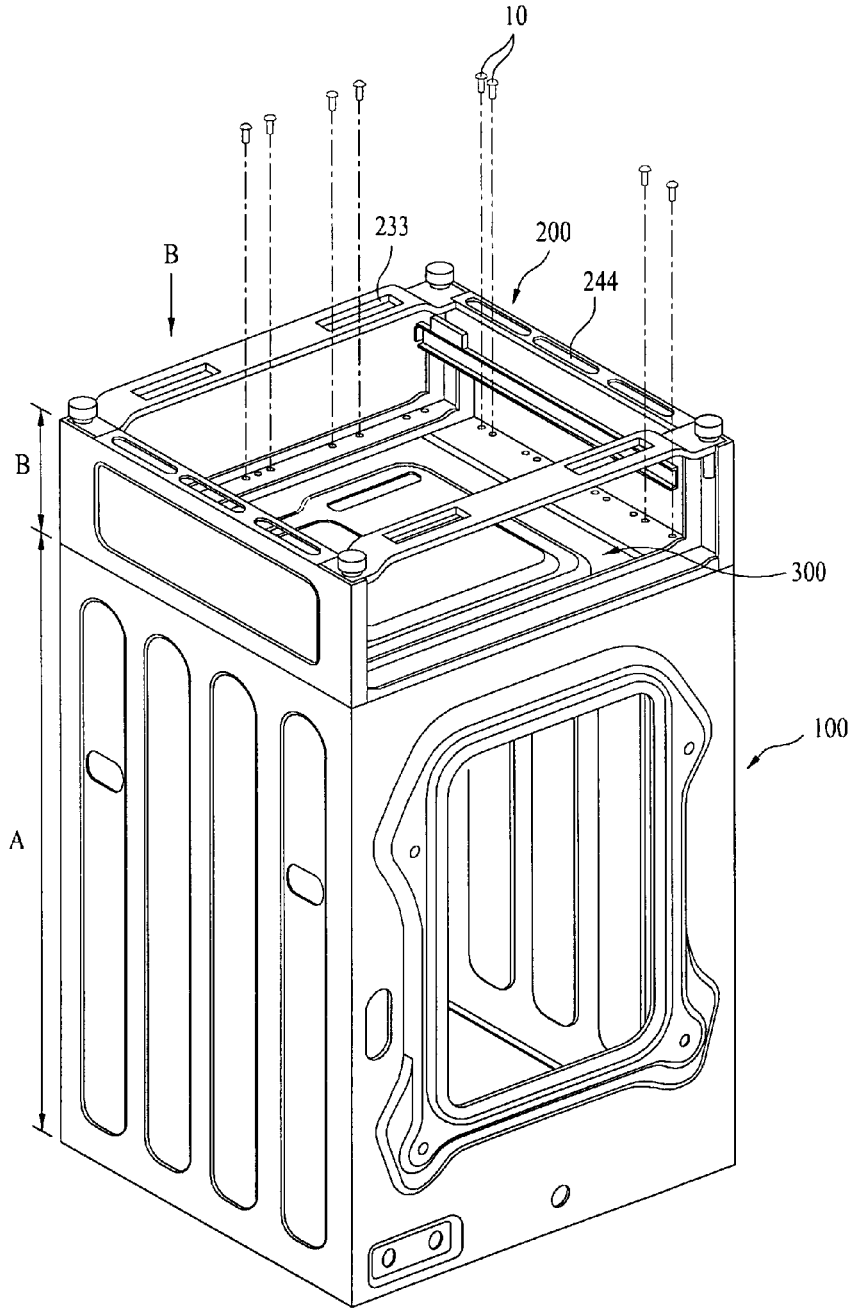

Once the disposing of the first cabinet 100 and the primary assemblies 200 and 300 is complete, the first cabinet 100 and the primary assembly 200 and 300 is fastened to each other by using the securing member 100 as shown in FIG. 4*c*.

As shown in FIG. 4*b*, the primary assembly 200 and 300 is substantially secured to a flange 100*a* formed at an edge portion of the bottom of the first cabinet 100. Specifically, as mentioned above, the securing member 10 secures the first cabinet 100 to the primary assembly 200 and 300 along a predetermined direction (B). That is, the securing member 10 passes through the second cabinet 200, the partition 300 and the first cabinet 100 in order. After that, the secured first cabinet and the assembly 200 and 300 may be turned upside down and the other devices are installed at the complete cabinet structure.

As mentioned above, the assembling method shown in FIGS. 4*a* to 4*c* enables the user to assemble the cabinet smoothly and conveniently, which can bring the substantially improved productivity.

Meanwhile, FIGS. 5-13 are drawings illustrating embodiments of washing machine having an auxiliary washing machine in the second space 200*a*.

Figure 5:
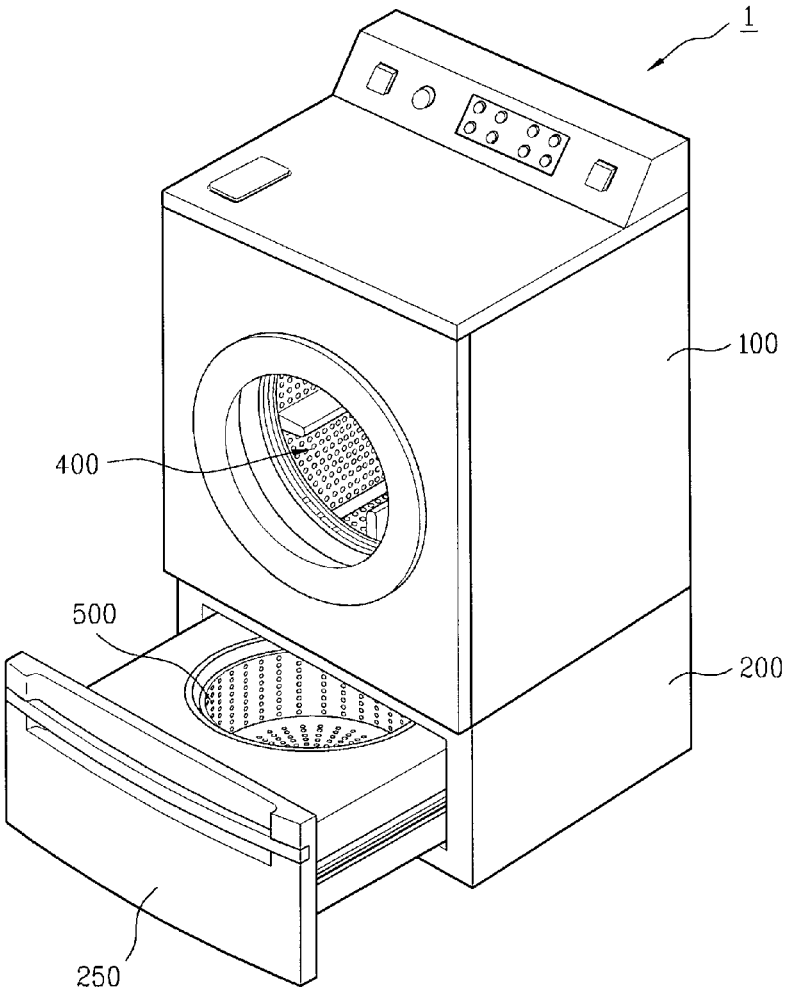
FIG. 5 is a perspective view of a washing machine having an auxiliary washing machine in accordance with one embodiment of the present invention.
Figure 6:
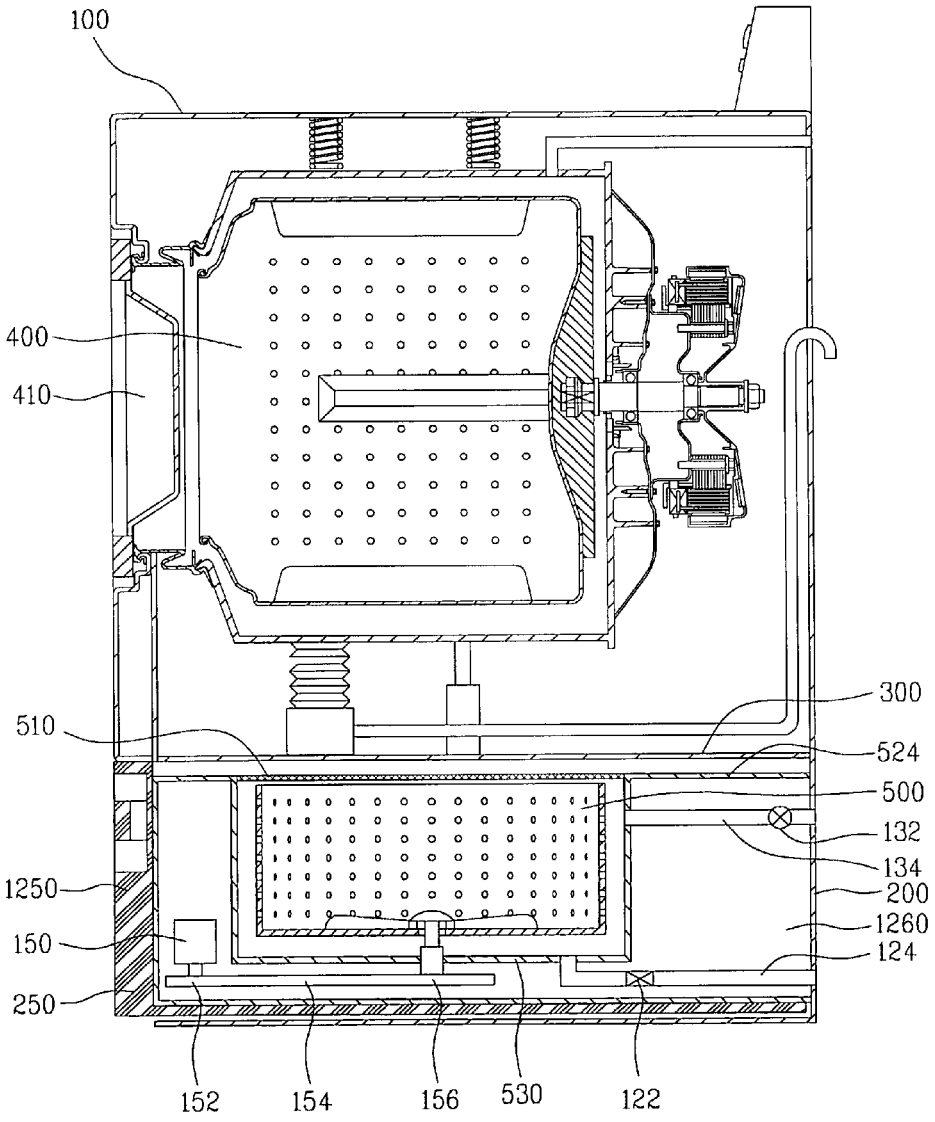
FIG. 6 is a sectional view of a washing machine of FIG. 5.

FIG. 5 illustrates a perspective view of a washing machine having an auxiliary washing machine in accordance with one embodiment of the present invention, and FIG. 6 illustrates a sectional view of a washing machine in accordance with an embodiment of the present invention.

The washing machine in accordance with an embodiment of the present invention will be described with reference to FIGS. 5 and 6.

Referring to FIGS. 5 and 6, the washing machine 1 includes a main drum 400 rotatably mounted in the first cabinet 100 for forming a space for holding large volume laundry, and a supplementary drum 500 rotatably mounted in the second cabinet 200 for forming a space for holding small volume laundry.

Accordingly, since both the large volume laundry and the small volume laundry can be treated with one washing machine without requiring a washing machine for treating the small volume laundry additionally, user's convenience can be improved. Moreover, in comparison to a case when both the large volume laundry and the small volume laundry are washed with separate washing machines respectively, the washing time period and the power consumption can be reduced.

The washing machine of the present invention will be described in more detail with reference to FIGS. 5 and 6. The supplementary drum 500 has a configuration for washing or drying the small volume laundry. The supplementary drum is rotated by a rotation shaft which is vertical to a bottom surface of the second cabinet 200, and has a plurality of pass through holes in a side wall for flow in/out of the washing water. The supplementary drum 500 has a water holding tub 530 on an outside of the supplementary drum 500 for holding the washing water, additionally.

The supplementary drum 500 may be positioned over or under the main drum 300. However, because frequency of washing the small volume laundry is lower than frequency of washing the large volume laundry, it is preferable that the supplementary drum 500 is positioned under the main drum 300.

In addition to this, the washing machine 100 includes a drawer 250 for housing the supplementary drum 500 and being drawable in a front direction of the second cabinet 200. The drawer 250 includes a front panel 1250 which forms a front exterior of the drawer, and a drum housing portion 1260 which is a space for housing the supplementary drum 500 therein.

The drawer 250 includes a frame 524 for covering the drawer 250, and it is preferable that the frame 524 and the water holding tub 530 are formed as one unit. A supplementary drum door 510 may be mounted to a top of the water holding tub 530 for introduction of the small volume laundry. Though not shown in the drawing, the supplementary drum door 510 may include a variety of locking device for locking the supplementary drum door 510. The supplementary drum door 510 can prevent the washing water from splashing to an outside of the supplementary drum 500.

In the meantime, referring to FIG. 6, the drawer 250 has a driving unit mounted therein for transmission of a driving power to the supplementary drum 500. The driving unit may be provided separate from the driving unit 350 which transmits a driving power to the main drum 300. For an example, the driving unit includes a motor 150 for transmission of rotating force to the supplementary drum 500, together with a driving pulley 152 connected to the rotation shaft of the motor 150, a follower pulley 156 connected to a rotation shaft of the supplementary drum 500, and a belt 154 which connects the driving pulley 152 to the follower pulley 156.

If the motor 150 rotates, the follower pulley 156 rotates through the driving pulley 152 and the belt 154, and if the supplementary drum 500 rotates accordingly, washing functions, such as washing, rinsing and spinning courses, can be performed. In the meantime, it is preferable that the motor 150 is reversible. In a case only the supplementary drum 500 is put into operation for washing the small volume laundry, the control unit (not shown) drives only the driving unit. According to this, power consumption required for the washing can be reduced.

Figure 7:
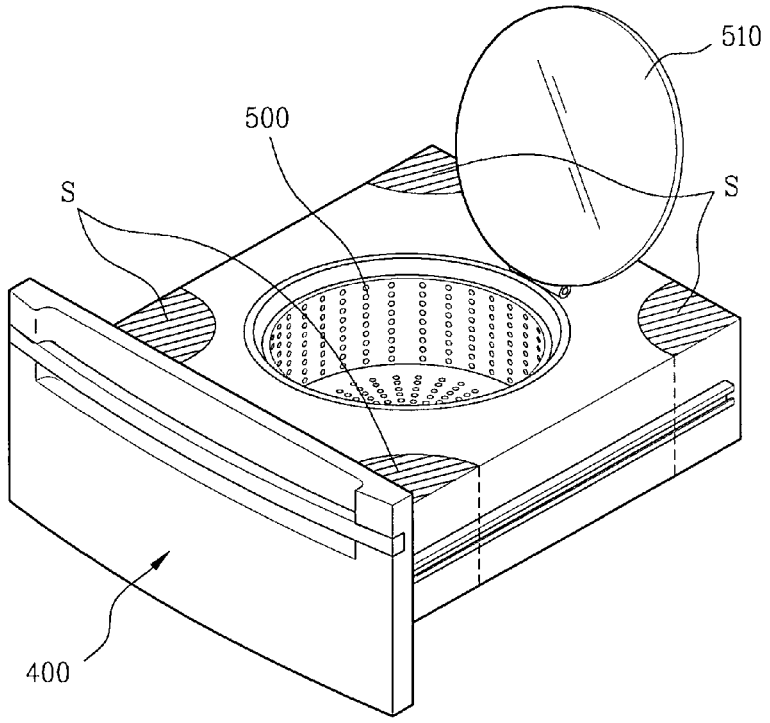
FIG. 7 is a perspective view of a drawer in a washing machine.

FIG. 7 illustrates a perspective view of a drawer in a washing machine in accordance with an embodiment of the present invention.

A position of the motor 150 will be described in detail with reference to FIG. 7. If the supplementary drum 500 is housed in the drawer 250, there can be spaces S formed at corners of the drawer 250. Therefore, the motor 150 can be mounted on a side of the supplementary drum 500. In other words, the motor 150 can be mounted in the space S formed between the water holding tub 530 and the drawer 250.

Though not shown, the motor 150 may be mounted to an outside surface of the water holding tub 530. In this case, the washing machine of the present invention can reduce a size of the drawer 250 in comparison to a case when the motor 150 is mounted under the supplementary drum 500.

Referring to FIG. 6, a water supply unit is mounted in the drawer 250 for supplying the washing water to the supplementary drum 500. The water supply unit may be provided separate from a water supply unit 330 which supplies the washing water to the main drum 300.

For an example, the water supply unit includes a water supply pipe 134 and a water supply valve 132 for supplying the washing water to an upper portion of the water holding tub 530. The water supply pipe 134 has one end connected to the upper portion of the water holding tub 530, and the other end fixed to an outside wall of the drawer 250. The water supply valve 132 may be mounted to the water supply pipe 134.

Particularly, it is preferable that the water supply pipe 134 is constructed of a material, or has a structure which is extendable in a drawing direction of the drawer, because it is required that the water supply pipe is extendable when the drawer 250 is drawn in a front direction of the cabinet 200.

In the meantime, referring to FIG. 6, a drain unit is mounted in the drawer 250 for draining the washing water from the supplementary drum 500 to an outside of the washing machine. The drain unit may be provided separate from a drain unit 320 which drains the washing water from the main drum 300 to an outside of the washing machine.

For an example, the drain unit may include a drain pipe 124 and a drain pump 122 for draining the washing water. The drain pipe 124 has one end connected to an underside of the water holding tub 530, and the other end fixed to an outside wall of the drawer 250. The drain pipe 124 has a drain pump 122 mounted thereto, and alike to the water supply pipe 134, it is preferable that the drain pipe 124 is constructed of a material, or has a structure which is extendable in a drawing direction of the drawer.

Figure 8:
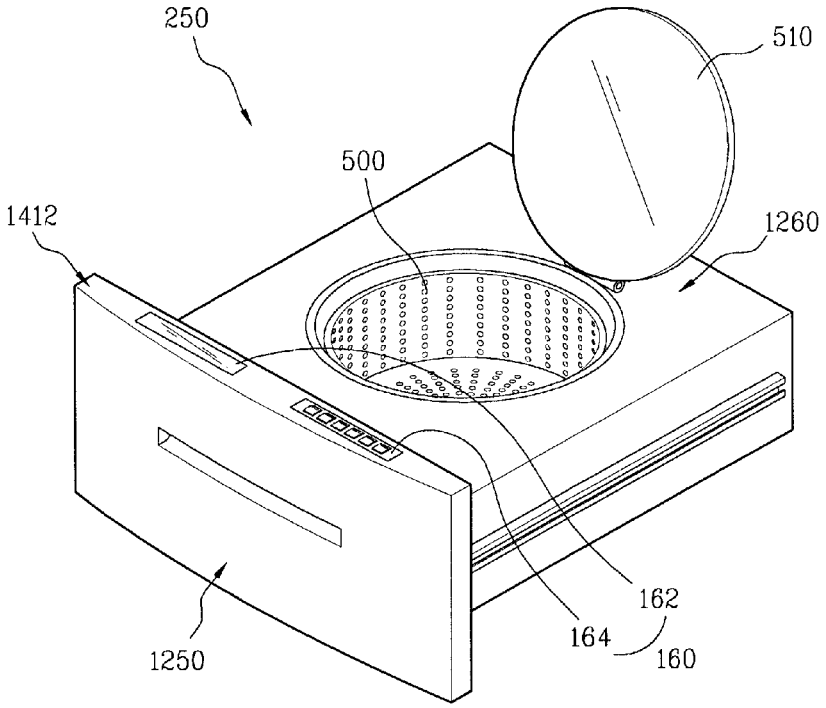
FIGS. 8, 9 and 10 are a plurality of embodiments of a drawer in a washing machine of the present invention.
Figure 9:
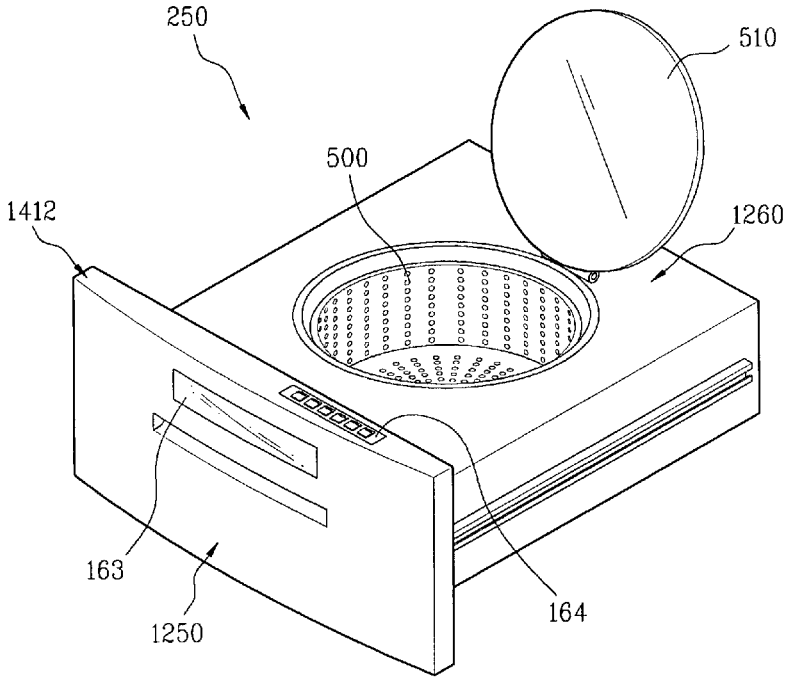
Figure 10:
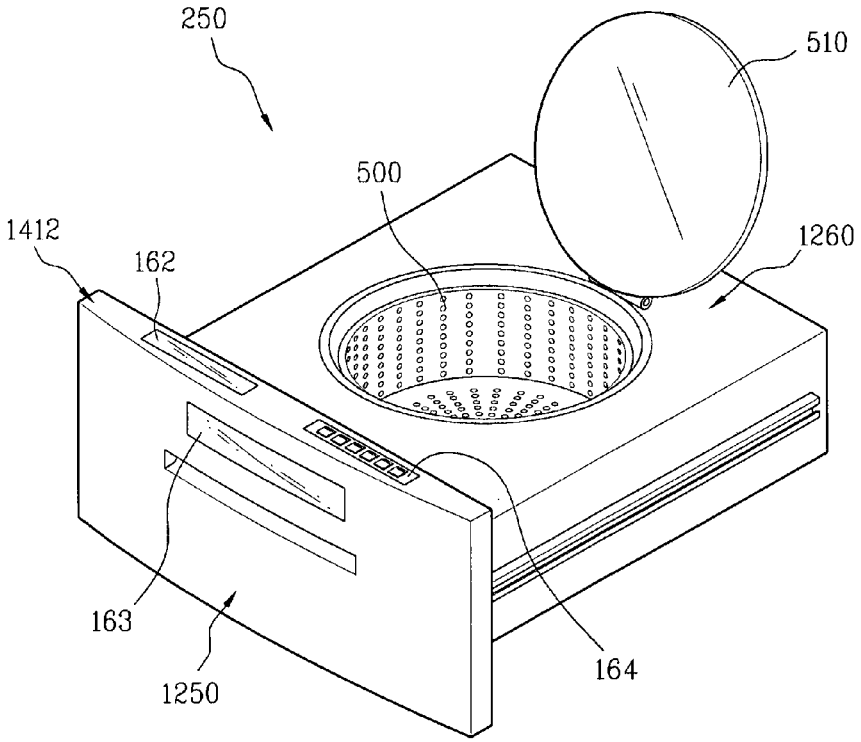

FIGS. 8, 9 and 10 illustrate a plurality of embodiments of a drawer in a washing machine of the present invention.

A first embodiment of drawer in a washing machine in accordance with the present invention will be described with reference to FIG. 8. The drawer 250 has an handling unit 160 on the front panel 1250 for handling driving of the supplementary drum 500.

The handling unit 160 includes an input unit 164 for user's inputting of functions of the supplementary drum 500 for operation of the supplementary drum 500. The handling unit 160 includes a display unit 162 and 163 for displaying an operation state of the supplementary drum 500 or an input state set by the input unit 164.

The input unit 164 enables the user to input a desired order or a washing course with a plurality of buttons. The input unit 164 may be mounted to a top surface 1412 or the front surface of the front panel 1250.

However, since the drawer 250 which houses the supplementary drum 500 has a structure drawable in a front direction of the second cabinet 200, it is preferable that the input unit 164 is mounted to the top surface 1412 of the front panel 1250 for making easy input in a state the drawer 250 is drawn.

FIG. 10 illustrates a perspective view of a third variation of a drawer in a washing machine of the present invention.

A display unit mounted to a drawer in the washing machine of the present invention will be described with reference to FIG. 10. The display unit may include a first display unit 162 for displaying an input state of the input unit 164 and an operation state of the supplementary drum 500, and a second display unit 163 for displaying only an operation state of the supplementary drum 500.

Positions of the first display unit 162 and the second display unit 163 will be described with reference to FIGS. 8, 9, and 10.

According to the drawer shown in FIG. 8, it is preferable that the first display unit 162 is mounted to the top surface 1412 of the front panel 1250. This is because the user can make easy notice of the input state of the input unit 164 and the operation state of the supplementary drum 400 without bending his(her) back forward.

In the meantime, according to the second variation of the drawer shown in FIG. 9, the second display unit 163 is mounted to the front surface of the front panel 1250.

This is because the second display unit 163 displays only the operation state of the supplementary drum 500 of a washing course or the like selected at the input unit 164.

That is, user's notice of the operation state of the supplementary drum 500 in a state the drawer 250 is pushed in the second cabinet 200 is preferable in view of convenience of the user.

Moreover, according to the third embodiment of the washing machine shown in FIG. 10, both the first display unit 162 and the second display unit 163 may be mounted to the front panel 1250 together. This is for enabling the user to notice the operation state of the supplementary drum 500 even in a state the drawer 250 is pulled out of the second cabinet 200 or pushed back into the second cabinet 200.

Meanwhile, the auxiliary washing machine may have a supply unit for supplying water to the supplementary drum separate from a supply unit for supplying water to the main drum.

Figure 11:
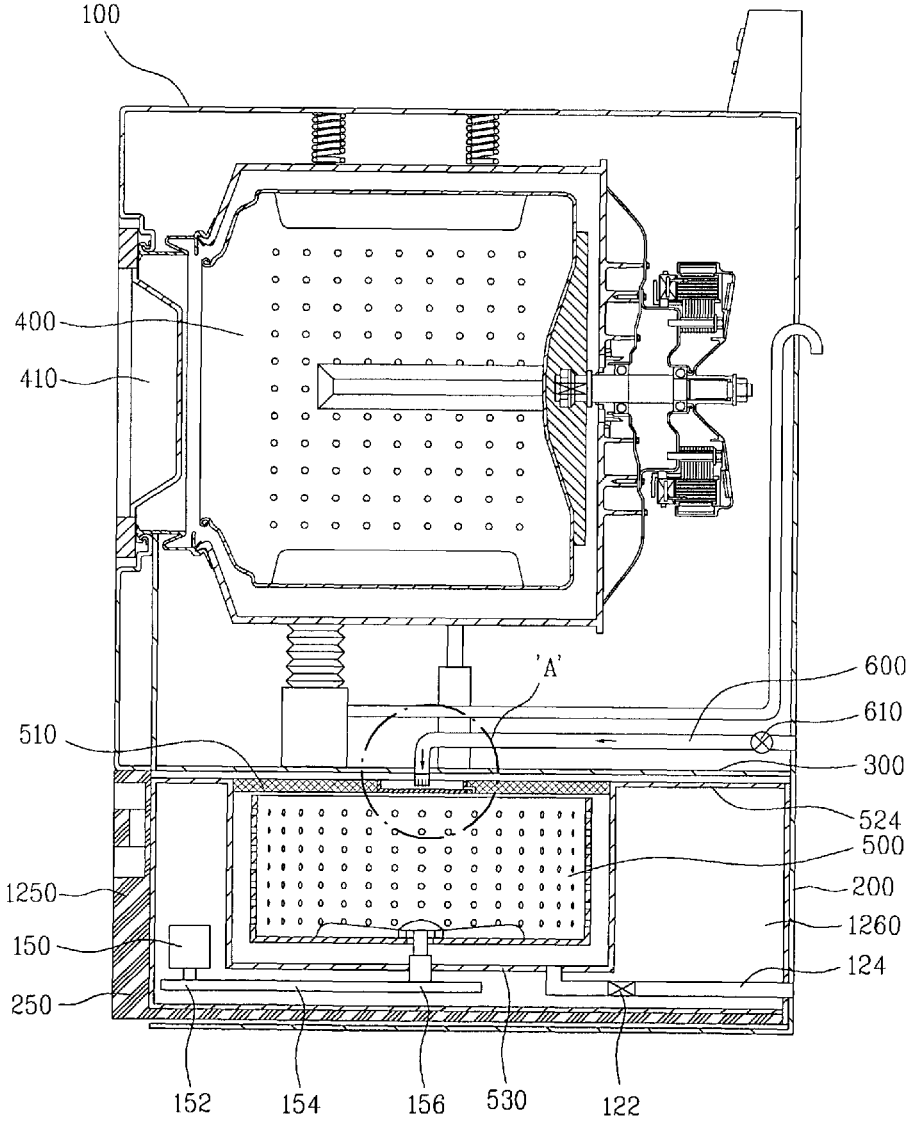
FIG. 11 is a sectional view of a washing machine in accordance with another embodiment of the present invention.
Figure 12:
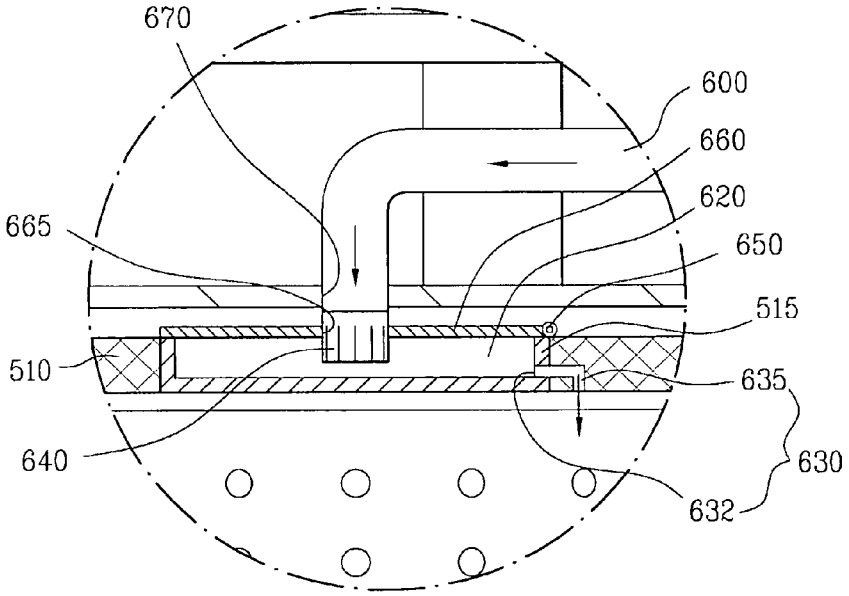
FIG. 12 is an enlarged view of the supply unit in FIG. 11.
Figure 13:
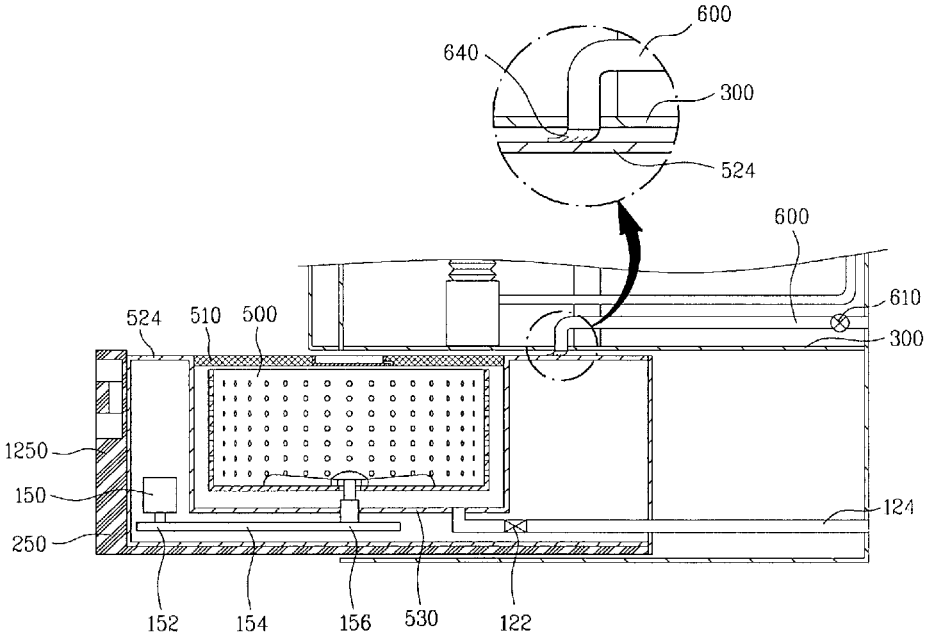
FIG. 13 is a sectional view of a washing machine with a drawer thereof in an open state.

FIG. 11 illustrates a sectional view of a washing machine in accordance with another embodiment of the present invention, with a drawer thereof in a closed state. FIG. 12 illustrates an enlarged view of the supply unit in FIG. 11, and FIG. 13 illustrates a sectional view of a washing machine with a drawer thereof in an open state.

The supply unit will be described with reference to FIGS. 11, 12 and 13. The washing machine 1 of the present invention includes a supply unit over the supplementary drum 500 for supplying the washing water to the supplementary drum 500, additionally.

The supply unit includes a detergent box 620 for holding detergent, a water supply pipe 600 for supplying the washing water to the detergent box 620, and a discharge portion 630 for discharging the washing water from the detergent box 620 to the supplementary drum 500.

The detergent box 620 includes a space for holding detergent, and a detergent box door 660 openably secured by a rotation portion 650. The detergent box door 660 may have a recess (not shown) for user's easy opening of the detergent box door 660.

Therefore, if it is intended to introduce to the detergent to the detergent box 620, the user can introduce the detergent to the detergent box 620 only by opening the detergent box door 660 without removing the detergent box 620 from the supplementary drum door 510.

The detergent door box 660 also has a door pass through hole 665 for introduction of the washing water from the water supply pipe 600 to the detergent box 620.

The supplementary drum door 510 includes a detergent box opening 515 for placing the detergent box 620 therein.

This is for making the detergent box 620 to be removable from the supplementary drum door 510.

Accordingly, if it is required to clean the detergent box 620 of accumulated remained detergent, the user can remove the detergent box 620 from the supplementary drum door 510 for cleaning.

The water supply pipe 600, above the detergent box 620, supplies the washing water to the detergent box 620, and has a water supply valve 610 for controlling opening/closing of the water supply pipe 600, additionally.

The water supply pipe 600 is provided in the space of the first cabinet 100 divided by the partition 300.

In detail, the water supply pipe 600 has one end passed through a partition pass through hole 670, and the other end fixed to an outside wall of the first cabinet 100. In the meantime, the water supply valve 610 is mounted to the water supply pipe 600.

It is preferable that the water supply pipe 600 is provided such that the washing water is supplied from above the supplementary drum 500, and a form of the water supply pipe 600 bent at 90 degrees is one of an example of the provision.

Accordingly, if the drawer 250 is pushed back into the second cabinet 200, an end of the water supply pipe 600 from which the washing water is discharged is positioned over the detergent box 620. That is, if the drawer 250 is pushed back into the second cabinet 200 fully, the end of the water supply pipe 600 connected to the partition pass through bole 670 can be placed in the door pass through hole 665 in the detergent box door 660. Accordingly, the washing water can be discharged to the detergent box 620 through the water supply pipe 600.

However, it is liable that the washing water can leak to a periphery of the detergent box 620 when the washing water is introduced to the detergent box 620 through the water supply pipe 600, and the end of the water supply pipe 600 runs into the supplementary drum door 510 or the frame 524 to interfere with movement of the drawer 250 when the drawer 250 moves.

Therefore, in order to make movement of the drawer 250 smooth, and prevent the washing water from leaking, it is preferable that the end of the water supply pipe 600 has a leakage preventive portion 640.

The leakage preventive portion 640, mounted along an outside circumference of the water supply pipe 600 in an axis direction of the water supply pipe 600, may have a tube shape.

An end of the leakage preventive portion 640 interferes with the supplementary drum door 510 or the frame 524 when the drawer 250 is pushed back into the second cabinet 200 or pulled out of the second cabinet 200. However, if the drawer 250 is pushed back into the second cabinet 200 fully, the leakage preventive portion 640 is placed in the door pass through hole 665 in the detergent box door 660.

In the meantime, it is preferable that the leakage preventive portion 640 is formed of a soft material. Therefore, the leakage preventive portion 640 may be formed of rubber or plastic, and the end of the leakage preventive portion 640 may be cut at fixed intervals in the axis direction. According to this, when the drawer 250 is pushed back into the second cabinet 200 or pulled out of the second cabinet 200, the interference of the leakage preventive portion with the drawer 250 can be minimized.

Though not shown, the drawer 250 may include a supplementary water supply unit for supplying the washing water to the supplementary drum 500, additionally.

The discharge portion 630 includes a discharge hole 632 in one side of the detergent box 620 for discharging the washing water, and a discharge pipe 635 connected to the supplementary drum 500.

Therefore, according to the washing machine described above, the unitedly assembled first and second cabinets can provide the user with the additional functions and can substantially reduce the material and works required in the manufacturing process of the washing machine. As a result, the productivity of the washing machine may be improved and the completely assembled washing machine may have an enhanced exterior appearance.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A washing machine comprising:

a tub holding wash water;

a drum rotatable within the tub to hold laundry;

a first cabinet defining a first space provided with the tub and the drum to wash laundry;

a second cabinet defining a second space for an additional function, the second cabinet formed as one body with the first cabinet;

a single partition provided between the first and the second cabinets to partition off the second space from the first space, the single partition formed separately from the first cabinet and the second cabinet; and a bracket installed on the single partition to secure the tub to the single partition and the bracket is coupled to a damper to dampen vibration of the tub, wherein the single partition is fastened to the first cabinet and the second cabinet respectively by a securing member, wherein the single partition has an edge portion and comprises a platform projected above the edge portion and capable of having an accessory to be mounted on, and a recess formed at a center of the platform capable of storing water leaked, if any, from the tub or the drum in the recess, and wherein a sensor is capable of being installed in the recess.

2. The washing machine of claim 1, wherein the single partition forms a predetermined portion of the first cabinet and a predetermined portion of the second cabinet simultaneously.

3. The washing machine of claim 1, wherein the single partition is directly in contact with both of the first and second spaces.

4. The washing machine of claim 1, wherein the second cabinet is provided under the first cabinet.

5. The washing machine of claim 4, wherein the single partition forms a bottom of the first cabinet and the single partition covers a top panel of the second cabinet simultaneously.

6. The washing machine of claim 1, wherein the second space accommodates an auxiliary washing machine.

7. The washing machine of claim 6, wherein the auxiliary washing machine comprises, an auxiliary tub holding wash water; and an auxiliary drum holding laundry.

8. The washing machine of claim 1, wherein the second space is configured to refresh shoes.

9. The washing machine of claim 8, wherein the second space accommodates shoes and the shoes are refreshed by hot air within the second space.

10. The washing machine of claim 1, wherein the second cabinet accommodates a drawer.

11. The washing machine of claim 1, wherein a side panel and a rear panel of the first cabinet are formed as one body with a side panel and a rear panel of the second cabinet, respectively.

12. The washing machine of claim 1, wherein the partition comprises a leg supporting means.

13. The washing machine of claim 12, wherein the leg supporting means comprises a coupling hole provided at each corner of the partition.

14. The washing machine of claim 1, further comprising a holder installed on the single partition to hold accessory of the washing machine.

15. The washing machine of claim 14, wherein the holder comprises, a base; and a first arm and a second arm extended upward from the base to hold the accessory.

16. The washing machine of claim 15, wherein the base comprises a seating portion which the accessory is seated on.

* * * * *